US011613962B2

(12) United States Patent
Egbe et al.

(10) Patent No.: US 11,613,962 B2
(45) Date of Patent: Mar. 28, 2023

(54) OPENING AN ALTERNATE FLUID PATH OF A WELLBORE STRING

(71) Applicant: Saudi Arabian Oil Company, Dhahran (SA)

(72) Inventors: Peter Ido Egbe, Abqaiq (SA); Victor Jose Bustamante Rodriguez, Abqaiq (SA); Sajid Hussain, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 93 days.

(21) Appl. No.: 17/188,740

(22) Filed: Mar. 1, 2021

(65) Prior Publication Data

US 2022/0275705 A1 Sep. 1, 2022

(51) Int. Cl.
*E21B 34/08* (2006.01)
*E21B 47/13* (2012.01)

(52) U.S. Cl.
CPC ..... *E21B 34/08* (2013.01); *E21B 47/13* (2020.05); *E21B 2200/06* (2020.05)

(58) Field of Classification Search
CPC ..... E21B 34/08; E21B 47/13; E21B 2200/06; E21B 34/06
See application file for complete search history.

(56) References Cited

U.S. PATENT DOCUMENTS 3,559,734 A 2/1971 Pitts
5,890,540 A * 4/1999 Pia ..... E21B 23/006 166/321
5,937,945 A 8/1999 Bussear et al.
6,679,336 B2 1/2004 Musselwhite et al.
6,712,145 B2 3/2004 Allamon
7,640,984 B2 1/2010 Vert et al.
8,403,078 B2 3/2013 Brunnert et al.
9,382,769 B2 7/2016 Wilson et al.
9,689,247 B2 6/2017 Holder et al.
(Continued)

FOREIGN PATENT DOCUMENTS

EP 1260671 11/2002
EP 1321624 6/2003
(Continued)

OTHER PUBLICATIONS

PCT International Search Report and Written Opinion in International Appln. No. PCT/US2022/08168, dated May 16, 2022, 16 pages.

*Primary Examiner* — Caroline N Butcher
(74) *Attorney, Agent, or Firm* — Fish & Richardson P.C.

(57) ABSTRACT

A wellbore assembly includes a wellbore string configured to be disposed within a wellbore. The wellbore assembly also includes a float collar coupled to a downhole end of the wellbore string. The float collar includes a housing, a check valve, and a sleeve. The housing includes a fluid outlet. The housing defines a fluid port that extends through a wall of the housing. The check valve is disposed within the housing between the fluid port and the fluid outlet. The sleeve is coupled to the wall of the housing uphole of the check valve. The sleeve moves, based on pressure changes of the fluid in the float collar, with respect to the wall of the housing thereby either exposing the fluid port and opening a fluid pathway from the bore to an annulus of the wellbore, or covering the fluid port and blocking the fluid pathway.

17 Claims, 6 Drawing Sheets

(56) References Cited

U.S. PATENT DOCUMENTS

| | | | | |
|---|---|---|---|---|
| 2013/0319767 | A1* | 12/2013 | Wilson | E21B 47/18 175/232 |
| 2017/0254195 | A1 | 9/2017 | Knight | |
| 2018/0313188 | A1* | 11/2018 | Antonsen | E21B 34/10 |
| 2021/0310338 | A1* | 10/2021 | Turley | E21B 23/042 |

FOREIGN PATENT DOCUMENTS

| | | |
|---|---|---|
| GB | 2348226 | 9/2000 |
| GB | 2505362 | 2/2014 |

* cited by examiner

OPENING AN ALTERNATE FLUID PATH OF A WELLBORE STRING

FIELD OF THE DISCLOSURE

This disclosure relates to wellbores, in particular, to methods and equipment for fluid circulation in a wellbore.

BACKGROUND OF THE DISCLOSURE

Wellbore strings such as drill strings and cementing string flow fluid pumped from a surface of a wellbore to a downhole location of the wellbore. Fluid can be pumped to lubricate components of the wellbore string, to clean the wellbore, to cement the wellbore, and to set packers and other components of the wellbore string. Fluid circulation can include the process of flowing fluid out of the wellbore string and up an annulus of the wellbore to the surface of the wellbore. Fluid circulation may be prevented when obstructions are present in the wellbore string or the annulus. Methods and equipment for improving fluid circulation in wellbores are sought.

SUMMARY

Implementations of the present disclosure include a wellbore assembly that includes a wellbore string configured to be disposed within a wellbore. The wellbore assembly also includes a float collar coupled to a downhole end of the wellbore string. The float collar includes a housing, a check valve, and a sleeve. The housing is coupled to the wellbore string. The housing includes a fluid outlet at a downhole end of the housing. The housing defines a fluid port that extends through a wall of the housing. The housing includes a bore configured to flow a fluid received from the wellbore string. The check valve is disposed within the housing between the fluid port and the fluid outlet. The check valve allows the fluid to flow in one direction along the bore of the float collar. The sleeve is coupled to the wall of the housing uphole of the check valve. The sleeve moves, based on pressure changes of the fluid in the float collar, with respect to the wall of the housing thereby either exposing the fluid port and opening a fluid pathway from the bore to an annulus of the wellbore, or covering the fluid port and blocking the fluid pathway.

In some implementations, the wellbore assembly also includes a biasing member coupled to the sleeve. The sleeve moves between a first position with the fluid port covered and a second position with the fluid port exposed. The biasing member urges the sleeve from the second position to the first position with the fluid at a first pressure, and the sleeve moves from the first position to the second position under fluidic pressure of the fluid at a second pressure greater than the first pressure. In some implementations, the wellbore assembly also includes a push-push assembly coupled to the sleeve and configured to allow the sleeve to move between a latched condition and an unlatched condition as the biasing member or fluidic pressure moves the sleeve in a direction parallel to the flow direction of the fluid, thereby alternately locking the sleeve into the first position and the second position as the sleeve is pushed by the biasing member or the fluidic pressure.

In some implementations, the wellbore assembly also includes a processor, a controller, an actuator, and a transceiver or sensor. The processor is coupled to the float collar. The controller is communicatively coupled to the processor. The actuator is communicatively coupled to the controller and operationally coupled to the sleeve to move the sleeve. The transceiver or sensor is communicatively coupled to the processor. The transceiver or sensor detects and transmits, to the processor, pressure information of the fluid. The processor determines, based on the pressure information, an actuator command. The processor transmits the actuator command to the controller and the controller is configured to activate, based on the actuator command, the actuator, moving the sleeve between the first position and the second position. In some implementations, the transceiver or sensor includes a radio-frequency identification (RFID) device that includes a piezoelectric crystal configured to generate, under pressure changes of the fluid, electric signals including encoded information. The RFID device configured to transmit, to the processor, the encoded information. The processor is configured to determine, based on the decoded information, an actuator command. The processor is configured to transmit the actuator command to the controller and the controller is configured to activate, based on the actuator command, the actuator, thereby moving the sleeve between the first position and the second position. In some implementations, the pressure information includes instructions encoded in pressure pulses of the fluid. The pressure pulses are sent through the wellbore string upon determining that a main fluid pathway of the wellbore string is clogged.

In some implementations, the wellbore assembly also includes a processor, a controller, an actuator, and a transceiver or sensor. The processor is coupled to the float collar. The controller is communicatively coupled to the processor. The actuator is communicatively coupled to the controller and operationally coupled to the sleeve to move the sleeve. The transceiver or sensor is communicatively coupled to the processor. The transceiver or sensor detects and transmits, to the processor, information from a triggering device flown in the fluid along the bore of the housing. The processor determines, based on the pressure information, an actuator command. The processor transmits the actuator command to the controller and the controller is configured to activate, based on the actuator command, the actuator, moving the sleeve between the first position and the second position.

In some implementations, the transceiver or sensor includes a first RFID device and the triggering device includes an second RFID device. One of the first and second RFID devices including a radio transmitter and the other of the first and second RFID devices including a radio receiver. The first RFID device transmits, to the processor, encoded information received from the radio transmitter. The processor decodes the information and determines, based on the decoded information, an actuator command. The processor transmits the actuator command to the controller and the controller is configured to activate, based on the actuator command, the actuator, thereby moving the sleeve between the first position and the second position.

In some implementations, the float collar is part of a completion string including a float shoe disposed downhole of the float collar, and a polished bore receptacle coupled to the float collar.

In some implementations, the sleeve is disposed inside the housing. The sleeve includes one or more sealing rings disposed between the sleeve and the wall of the housing to form a fluid seal between the bore and the annulus with the sleeve in the first position.

Implementations of the present disclosure also include a wellbore assembly that includes a wellbore string disposed within a wellbore. The wellbore string includes a tubular body defining a bore that flows fluid from a surface of the wellbore to a downhole end of the wellbore. The wellbore string includes a fluid outlet at the downhole end of the wellbore and includes a fluid port extending through the tubular body. The fluid port resides uphold of the fluid outlet. The wellbore assembly also includes a sleeve coupled to the tubular body uphole of the fluid outlet. The sleeve moves, based on pressure changes in the wellbore string, with respect to the tubular body, thereby either exposing the fluid port and opening a fluid pathway from the bore to an annulus of the wellbore, or covering the fluid port and blocking the fluid pathway.

In some implementations, the sleeve is disposed inside a sub that includes the fluid ports and is coupled to the wellbore string. The sub includes a tubular wall including the fluid port, and a spring coupled to the sleeve. The sleeve moves between a first position with the fluid port covered and a second position with the fluid port exposed. The spring moves the sleeve from the second position to the first position with the fluid at a first pressure. The sleeve moves from the first position to the second position under fluidic pressure of the fluid at a second pressure greater than the first pressure.

In some implementations, the wellbore assembly further includes a push-push assembly coupled to the sleeve and configured to allow movement of the sleeve between a latched condition and an unlatched condition as the biasing member or fluidic pressure moves the sleeve in a direction parallel to the flow direction of the fluid, thereby alternately locking the sleeve into the first position and the second position as the sleeve is pushed by the biasing member or the fluidic.

In some implementations, the sub further includes a processor, a controller, and a transceiver or sensor. The processor is coupled to the sub. The controller is communicatively coupled to the processor. The actuator is communicatively coupled to the controller and is operationally coupled to the sleeve and configured to move the sleeve. The transceiver or sensor is communicatively coupled to the processor. The transceiver or sensor detect and transmit, to the processor, pressure information of the fluid. The processor determines, based on the pressure information, an actuator command. The processor transmits the actuator command to the controller and the controller is configured to activate, based on the actuator command, the actuator, moving the sleeve between the first position and the second position.

In some implementations, the sub further includes a processor, a controller, and a transceiver or sensor. The processor is coupled to the sub. The controller is communicatively coupled to the processor. The actuator is communicatively coupled to the controller and is operationally coupled to the sleeve and configured to move the sleeve. The transceiver or sensor is communicatively coupled to the processor. The transceiver or sensor detects and transmits, to the processor, information from a triggering device flown in the fluid along wellbore string. The processor determines, based on the pressure information, an actuator command. The processor transmits the actuator command to the controller and the controller is configured to activate, based on the actuator command, the actuator, moving the sleeve between the first position and the second position.

Implementations of the present disclosure include a method that includes receiving, by a processing device coupled to a controller and from one or more transceivers or sensors coupled to a wellbore string disposed within a wellbore, information including operation instructions. The controller is operationally coupled to an actuator configured to move a sleeve between a first position with a fluid port of the wellbore string exposed and a fluid pathway between a bore of the wellbore string and an annulus of the wellbore open, and a second position with the fluid port covered and the fluid pathway closed. The method also includes determining, by the processing device and based on the information, an actuator command. The method also includes transmitting, by the processing device and to the controller, the actuator command. The controller moves, based on the actuator command, the actuator, thereby moving the sleeve between the first position and the second position.

In some implementations, the actuator command includes one of 1) instructions to extend the actuator thereby exposing the fluid port or 2) instructions to retract the actuator thereby covering the fluid port. In some implementations, the actuator command includes instructions to extend the actuator upon determining that a main fluid outlet of the wellbore string is blocked.

In some implementations, the one or more transceivers or sensors includes an RFID device and the information includes encoded information transmitted via pressure pulses. The RFID device is configured to transmit the encoded information to the processor and the processor is configured to decode the encoded information.

In some implementations, the one or more transceivers or sensors includes a first RFID device and the information includes encoded information transmitted via electromagnetic waves from a second RFID device flown with the fluid along the wellbore string. The first RFID device is configured to transmit the encoded information to the processor and the processor configured to decode the encoded information.

DETAILED DESCRIPTION OF THE DISCLOSURE

The present disclosure describes a sleeve assembly that includes an internal sleeve (e.g., a smart shifting sleeve) that provides an alternate fluid pathway in a wellbore string. Some wellbore strings disposed within a wellbore circulate fluid from the string to an annulus of the wellbore. When the main fluid pathway is blocked, the sleeve can be used to open an alternate fluid pathway to re-establish fluid circulation. The sleeve can be a component of a completion string (e.g., as part of a float collar or used instead of a sliding sleeve device), or can be part of a standalone sub used with any wellbore string such as a production string or a drilling string. The sleeve shifts positions to cover or expose fluid ports of the wellbore string to open or close the alternate fluid pathway. The sleeve assembly can include a locking assembly (e.g., a latch ratchet assembly or a push-push assembly) that allows the sleeve to move in a direction parallel to the flow direction of the fluid under fluidic pressure pushing the sleeve along the direction of the fluid or by a spring pushing the sleeve in a direction opposite the fluid. The locking assembly locks the sleeve into a first position, with the fluid ports covered, and a second position with the fluid ports exposed and the alternate fluid pathway opened. The sleeve assembly can also include a drive assembly that includes a radio-frequency identification (RFID) device communicatively coupled to a processor and an actuator configured to move the sleeve between the first position and the second position based on information detected by the RFID device.

Particular implementations of the subject matter described in this specification can be implemented so as to realize one or more of the following advantages. For example, the sleeve assembly of the present disclosure can help avoid unplanned trips by providing emergency circulation path for plugged completion strings. The alternative flow path can be used for multiple operations such as cementing sections of a wellbore, cleaning the annulus of a wellbore, displacing tubing-casing annulus with inhibited fluids, depressurizing the wellbore string, and circulating a ball to activate components of the wellbore string (e.g., packers, liner hanger systems, multi task valves, and injection control devices). The sleeve assembly of the present disclosure can open the alternate fluid pathway when there is no fluid circulation in the wellbore string, allowing the sleeve to open without the need for additional equipment or costly operations.

Figure 1:
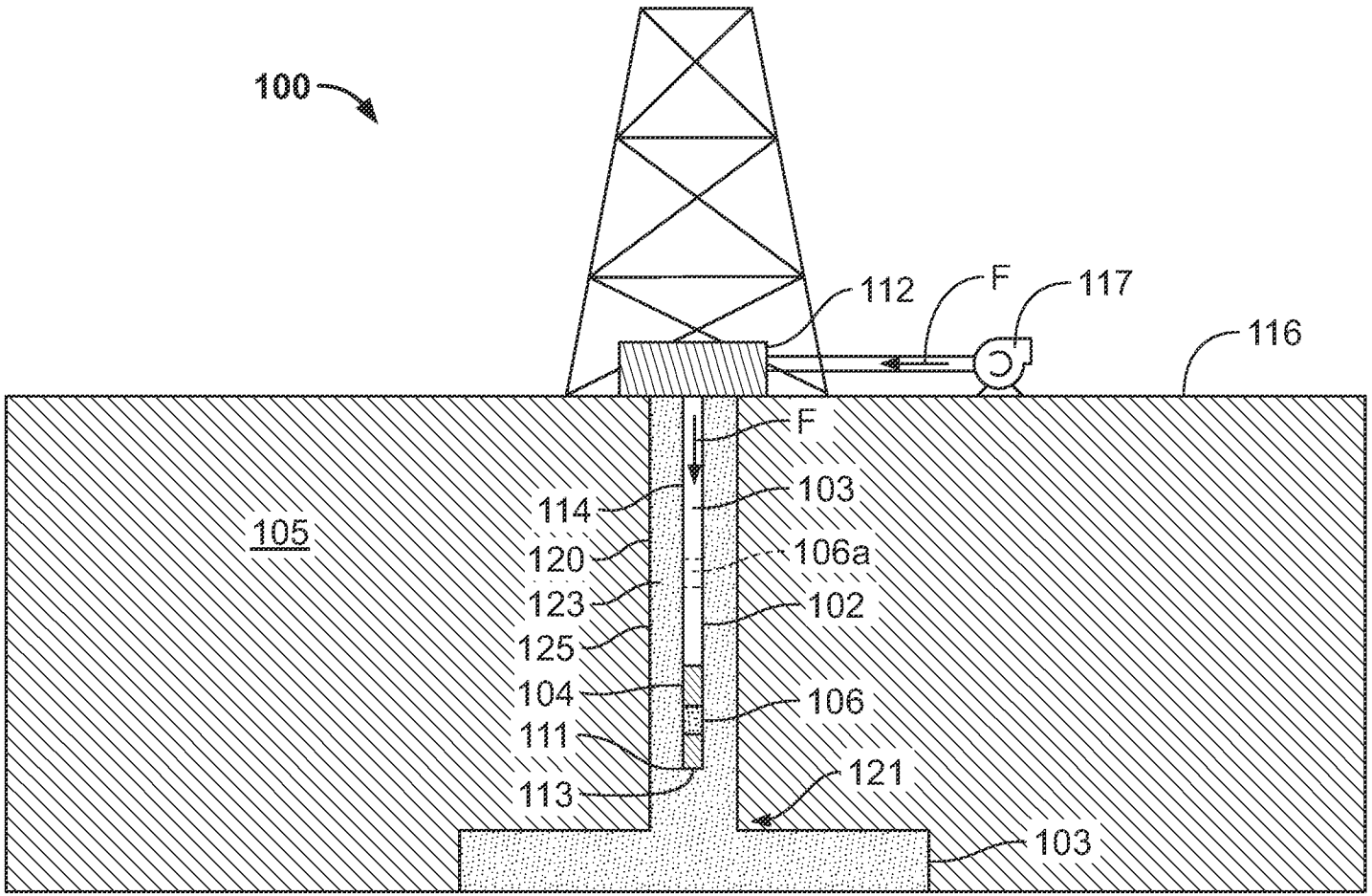
FIG. 1 is a front schematic view of a wellbore assembly according to implementations of the present disclosure.

FIG. 1 shows a wellbore assembly 100 implemented in a vertical wellbore 120. The wellbore assembly 100 includes a wellbore string 102 (e.g., a drill string) disposed within the wellbore 120. The wellbore 120 extends from a ground surface 116 of the wellbore 120 to a downhole end 121 of the wellbore 120. The wellbore 120 is formed in a geologic formation 105 that can include a hydrocarbon reservoir 107 from which hydrocarbons can be extracted. The wellbore assembly 100 can extend from a wellhead 112 or a different component at the surface 116 of the wellbore 100.

The wellbore assembly 100 also includes a lower completion string 104 coupled to a downhole end of the wellbore string 102. The wellbore assembly 100 also includes a sleeve assembly 106 disposed inside the wellbore completion string 104. For example, as further described in detail below with respect to FIG. 2, the sleeve assembly 106 can be part of a float collar or can be attached to completion string 104 uphole of the float collar. Additionally, as further described in detail later with respect to FIG. 6, a second sleeve assembly **106*a* similar to the sleeve assembly 106 can be part of a standalone sub coupled to a wellbore string (e.g., a drill string, a production string, or a different string) and used instead of or in addition to the sleeve assembly 106**.

The wellbore assembly 100 also includes a pump 117 that resides at or near the surface 116 of the wellbore. The pump 117 flows fluid 'F' (e.g., drilling fluid or cement) down the wellbore string 102 (e.g., through a bore 103 of the drill string 102) to or near a downhole end 111 of the wellbore string 102. During normal operations, the fluid 'F' flows through a main fluid pathway of the wellbore string 102. For example, the main fluid pathway extends from the wellbore string 120 through a downhole fluid outlet 113 of the wellbore string or the completion string into an annulus 123 of the wellbore 120. The fluid 'F' leaves the wellbore string 102 through the fluid outlet 113 and flows up the annulus 123 of the wellbore 120 to or near the surface 116 of the wellbore 120. The annulus 123 can be defined as the space between an exterior surface of the wellbore string 102 (or the completion string 104) and a wall 125 of the wellbore 120. Upon determining that the wellbore string 102 has an obstruction (e.g., that the main fluid pathway is blocked or partially blocked), the pump 117 helps activate the sleeve assembly 106 to open an alternate fluid pathway. To activate the sleeve assembly 106, the pump can flow one or more triggering devices with the fluid 'F' or it can apply pressure pulses by increasing and decreasing the fluidic pressure of the fluid 'F' during predetermined time intervals.

Figure 2:
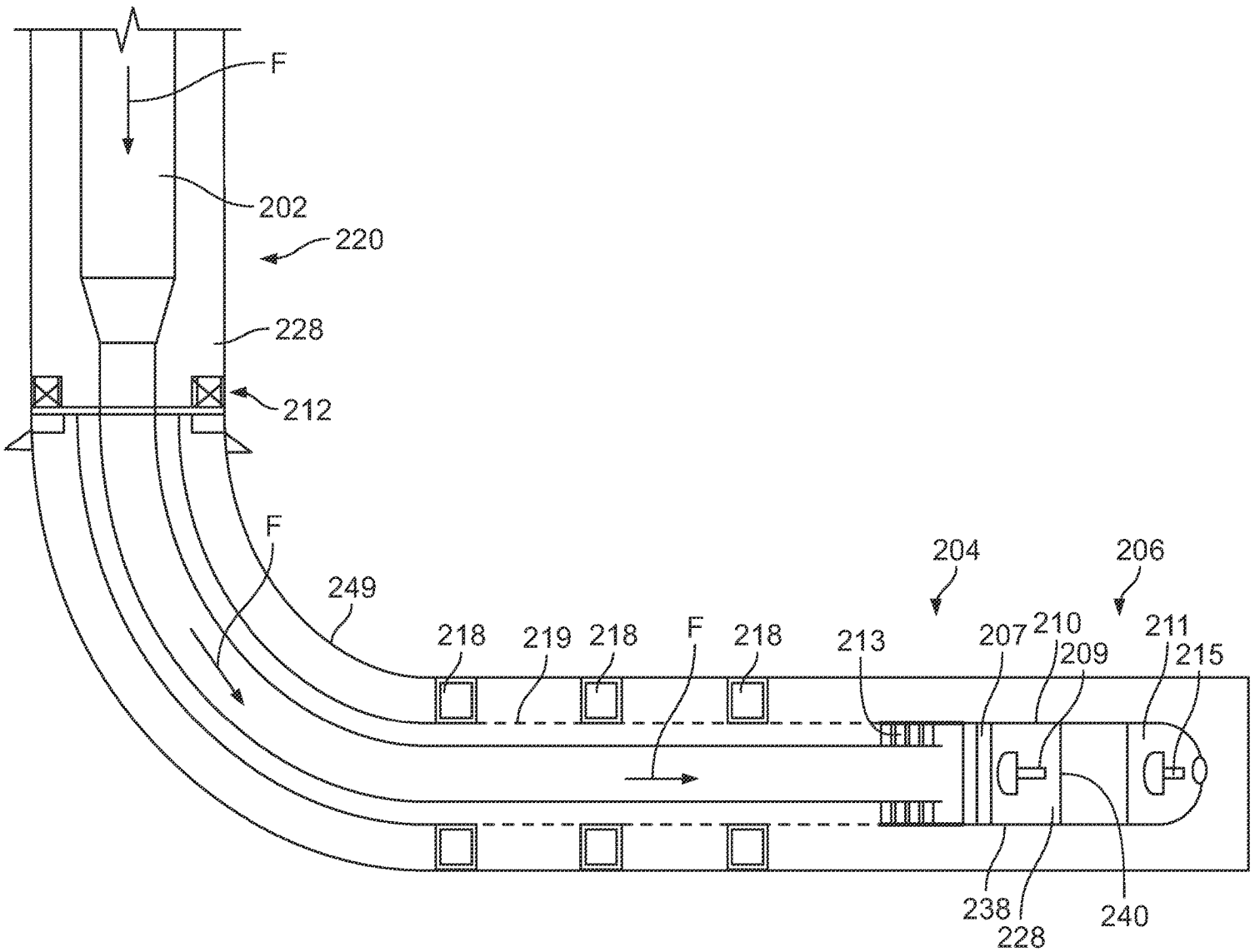
FIG. 2 is a front schematic view of a completion string according to implementations of the present disclosure.

FIG. 2 shows an implementation of the sleeve assembly 206 in a non-vertical wellbore 220. The non-vertical wellbore includes a cased section 228 and an open-hole section 229. The wellbore string 202 can be at least partially disposed within the cased section 228 of the wellbore 220, and the lower completion string 204 can be at least partially disposed within the open-hole section 229 of the wellbore 220. The lower completion string 204 can be hung on a hanger assembly 212 residing at or near an end of the cased section 228 of the wellbore 220. FIG. 2 shows the sleeve assembly 206 as part of a float collar 210 coupled to a downhole end of the wellbore string 220, however, the sleeve assembly 206 can be implemented anywhere along the lower completion string 204 or the wellbore string 202. For example, the sleeve 106 can be part of a standalone sub that is utilized as an integral string component to replace, for example, conventional sliding sleeve devices (SSD).

The lower completion string 204 has multiple packers 218 (e.g., isolation mechanical packers) that provide isolation between different reservoir compartments to enable communication between different pay zones along the same horizontal reservoir section. The mechanical packers 218 can redirect the fluids between the packers only and avoiding the wellbore fluids to flow into other reservoir zones and to prevent water fluid coming from other compartments being mixed with produced hydrocarbons. The lower completion string 204 can also include mesh screens 219 that block sand and rocks from flowing with the production fluid into the tubing of the lower completion string 204.

The downhole completion string includes the float collar 210, a float shoe 211 disposed downhole of the float collar 210, and a polished bore receptacle 213 coupled to the float collar 210. The float collar 210 includes a bore 228 through which the fluid 'F' flows toward the float shoe 211. The float collar 210 can be disposed between the float shoe 211 and the polished bore receptacle 213. Both the float collar 210 and the float shoe 211 can include a check valve 209 and 215 to allow the fluid 'F' to flow in one direction along the bore 228 of the float collar 210.

The float collar 210 has a housing 238 coupled (e.g., threadedly attached) to the lower completion string 204. The float collar 210 has a fluid outlet 240 at a downhole end of the housing 238. As further described in detail below with respect to FIGS. 3-5, the housing 238 defines one or more fluid ports extending through a wall of the housing to form the alternate fluid pathway. The check valve 209 of the float collar 210 is disposed within the housing 238 between the fluid port and the fluid outlet 240. The sleeve assembly 206 includes a sleeve 207 (e.g., a smart shifting sleeve) coupled to the wall of the housing 238 uphole of the check valve 209.

Figure 3:
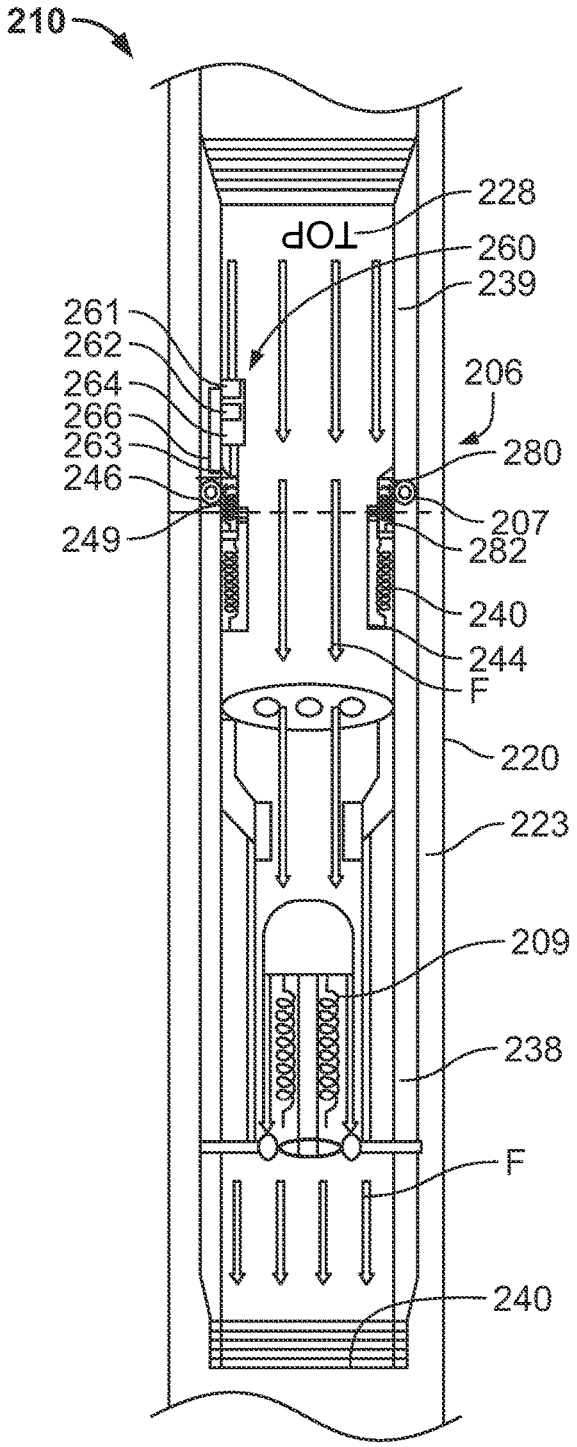
FIGS. 3-5 are front schematic views, partially cross-sectional, of sequential steps to open a fluid pathway in a float collar according to implementations of the present disclosure.
Figure 4:
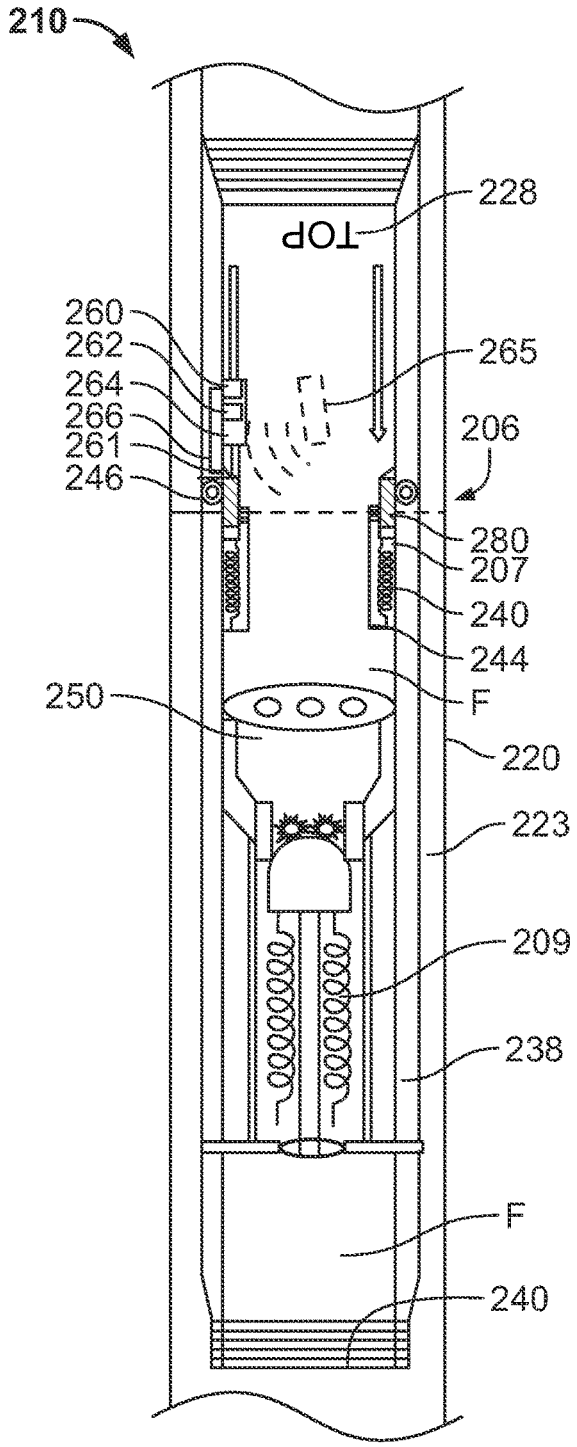
Figure 5:
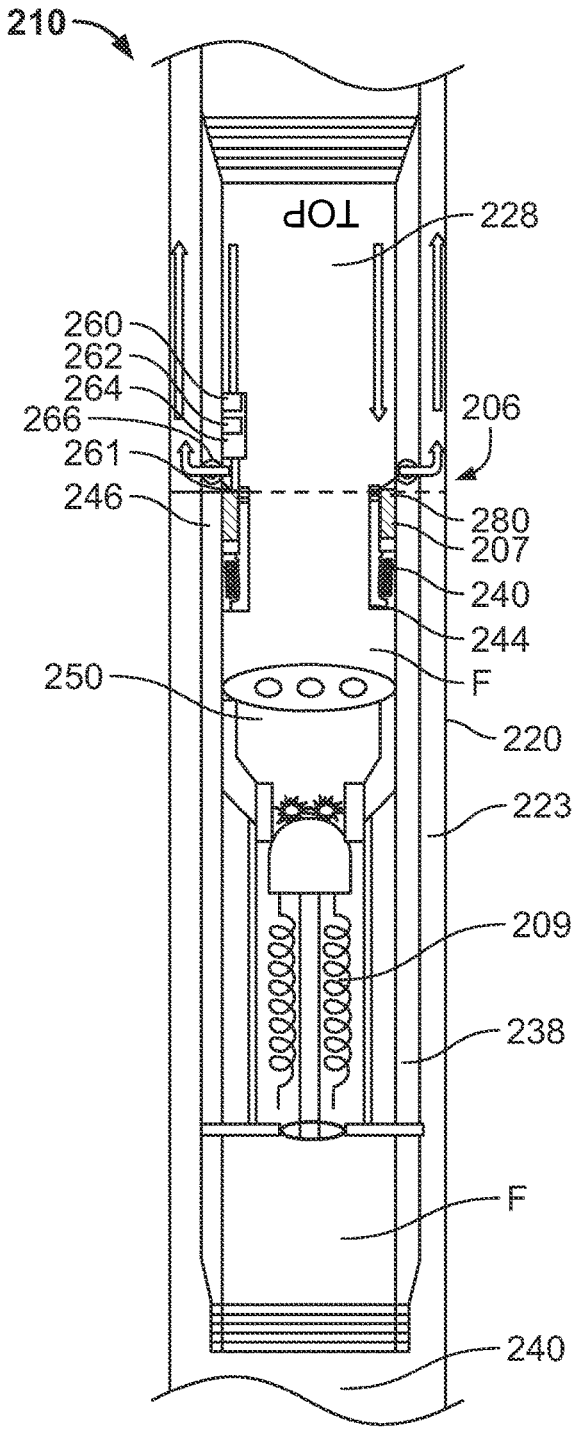

Referring now to FIGS. 3-5, a drive assembly 260 can be used inside the float collar 210 to open and close an alternate fluid pathway. As shown in FIG. 3, the sleeve 207 is moved by the drive assembly 260 to cover and expose fluid ports 246 of the float collar 210.

The sleeve assembly 206 includes a biasing member 240 (e.g., a spring such as an annular spring or multiple springs) coupled to the sleeve 207. The biasing member 240 can be disposed within a housing 240 that includes a sealing ring 282 to form a fluid seal between the bore 228 of the float collar 210 and an interior volume of the housing 240 containing the biasing member 240. The biasing member 240 moves the sleeve 207 along a length of the float collar 210 along a wall 239 of the housing 238 of the float collar 210. The sleeve 207 moves between a first position (as shown in FIG. 3) with the fluid ports 246 covered, and a second position (as shown in FIG. 5) with the fluid ports 246 exposed. The fluid 'F' helps activate (e.g., through pressure changes or by flowing a triggering device) the drive assembly 260 to move the sleeve 207 and the biasing member 240 helps move, in cooperation with the drive assembly 260, the sleeve 207 between the first position and the second position to the first position.

The sleeve assembly 206 also includes a locking assembly 249 (e.g., a push-push assembly or a latch ratchet assembly) that can include a spring and a cam and pin assembly (e.g., a cam that includes a groove that guides a pin). For example, the locking assembly 249 can include a pin and a groove that includes a latched section and an unlatched section. The pin follows the groove between the latched section and the unlatched section as the sleeve moves between the second position and the first position respectively. The pin follows the groove to rotate the sleeve as the biasing member or fluidic pressure moves the sleeve in a direction parallel to the flow direction of the fluid, thereby alternately locking the sleeve into the first position and the second position as the pin moves along the groove. In other words, when the sleeve is pushed in a downhole direction by fluidic pressure (or by an actuator), the mechanical lock latches into a grove. To release the sleeve, the sleeve is again slightly depressed to trigger the latch-ratchet which can perform a slight circular motion to then align the lock with an "open position" grove path. The spring urges the sleeve along the open position groove path to cover the fluid port.

The sleeve 207 is disposed inside the housing 238 and includes one or more sealing rings 280 that reside between the sleeve 207 and the wall 239 of the housing 238 to form a fluid seal between the bore 228 and the annulus 223 when the sleeve 207 is in the first position covering the fluid ports 246. The sealing rings 280 ensure that tubing integrity is maintained during the "closed" position.

Still referring to FIG. 3, the drive assembly 260 includes a processing device 261 (e.g., a processor) coupled to the wall 239 of the float collar 210, a controller 262 communicatively coupled to the processor 261, an actuator 264 (e.g., a mechanical drive or linear actuator) attached to the wall 239 of the float collar 210, and a transceiver or a sensor 263 communicatively coupled (e.g., through a cable 266) to the processor 261.

The controller 262 can be coupled to the actuator 264. In some implementations, the controller 262 can be at the surface of the wellbore. In some implementations, the controller 262 can be implemented as a distributed computer system disposed partly at the surface and partly within the wellbore. The computer system can include one or more processors and a computer-readable medium storing instructions executable by the one or more processors to perform the operations described here. In some implementations, the controller 262 can be implemented as processing circuitry, firmware, software, or combinations of them. The controller 262 can transmit signals to the actuator 264 to trigger or activate the actuator to move the sleeve 207.

The actuator 264 is communicatively coupled to the controller 262 and operationally coupled to the sleeve 207. For example, an arm of the actuator 264 can be attached to a rim of the sleeve 207 such that extending the arm moves the sleeve away from the controller 262 and retracting the arm moves the sleeve 207 toward the controller 262.

The transceiver or sensor 263 can be an RFID device such as an RFID tag that detects and transmits, to the processor 261, information to activate the actuator 264. For example, as shown in FIG. 2, when it is determined that an obstruction 250 (e.g., debris) at check valve 209 is blocking the main fluid pathway of the float collar 210, the sleeve assembly 206 is activated to open an alternate fluid pathway The RFID device 263 can detect pressure changes in the fluid 'F' or can detect an electromagnetic field of a second RFID device flown in the fluid. For example, when the main fluid pathway is completely blocked and no fluid circulation is possible, the fluid pump (shown in FIG. 1) can send pressure pulses through the string to encode information for the RFID device to detect.

In implementations in which no fluid circulation is possible, the fluid pump increases and decreases the pressure of the fluid 'F', encoding information in the pressure pulses. In other words, the pump can encode drilling fluid pressure signal pulses generated uphole that propagates through the fluid 'F' for the RFID 263 device to detect. The encoded information (e.g., pressure information) is transmitted to the processor 261 and the processor 261 determines, based on the pressure information, an actuator command that may include either a command to extend the actuator 261 or retract the actuator 264. The processor 261 transmits the actuator command to the controller 262 and the controller activates or triggers, based on the actuator command, the actuator 264. As shown in FIG. 5, the processor can transmit a command to the controller to extend the actuator 261, which in turn moves the sleeve 207 to expose the fluid ports 266 of the float collar 210. The fluid ports 266 open the alternate fluid pathway that extends from the bore 228 of the float collar 210 through the wall 239 and to the annulus 223 of the wellbore 220. Once the operation is complete, a second 'message' is sent downhole via pressure pulses to activate the actuator and move the sleeve 207 from the second position to the first position and close the alternate fluid pathway.

In some implementations, the RFID device 263 includes a piezoelectric crystal that generates, under pressure changes of the fluid, electric signals that include the encoded information in the pressure pulses. For example, electric polarization can be generated by applying mechanical stress to the dielectric crystals (and vice-versa) embedded in the RFID device 263. The RFID device 263 transmits, to the processor 261, the electric signals that include the encoded information. The processor 261 decodes the information and determines, based on the decoded information, an actuator command. The processor 261 transmits the actuator command to the controller 262 and the controller 262 activates, based on the actuator command, the actuator 264. Upon activated, the actuator 264 moves the sleeve 207 between the first position and the second position.

Referring back to FIG. 4, when some fluid circulation is possible (e.g., there is a partial obstruction of the main fluid pathway), the surface pump can flow a triggering device 265 (e.g., a second RFID device) to trigger the RFID device 263. The triggering device 256 can be an RFID reader that contains encoded instructions that are picked up by the RFID tag 263. The RFID devices 263 and 265 can be "passive" markers, e.g., a marker which does not emit a signal. However, other embodiments could employ active markers (e.g., RFID tag markers).

RFID passive tags do not require a power source (e.g. a battery). Passive RFID tags can be powered up in the interrogating field of the RFID reader as data exchanges take place. Passive RFID tags may work in either magnetic coupling, electric coupling, or electromagnetic coupling (i.e. near & far field backscattering). The RFID device 263 can be a far-field backscattering RFID tag. The tag captures the energy of continuous waves from the RFID reader 265. A power converter that can part of the drive assembly 260 can rectify the alternating potential difference (electromagnetic energy) across the antenna. The scavenged energy can be used to power up the circuitry on the RFID tag. The RFID tag can send data to the reader using a backscattering mechanism. The modulation can be performed by changing the antenna's impedance over time, so the RFID tag can reflect back more or less of the incoming signal in a pattern that encodes the tag's ID. There can be instructions embedded or pre-programmed in the RFID reader to operate the sleeve assembly 206. The RFID device can be send in the fluid 'F' when there is no obstruction of the main fluid pathway, such as to activate components of the wellbore.

The RFID device 263 detects the electromagnetic wakes of the second RFID device 265. One of the first and second RFID devices includes a radio transmitter and the other of the first and second RFID devices includes a radio receiver. The first RFID device 263 transmits, to the processor, encoded information received from the radio transmitter of the second device 265. The processor 261 decodes the information and determines, based on the decoded information, an actuator command. The processor 261 transmits the actuator command to the controller 262 and the controller 262 activates, based on the actuator command, the actuator 264. Upon activated, the actuator 264 moves the sleeve 207 between the first position and the second position.

Figure 6:
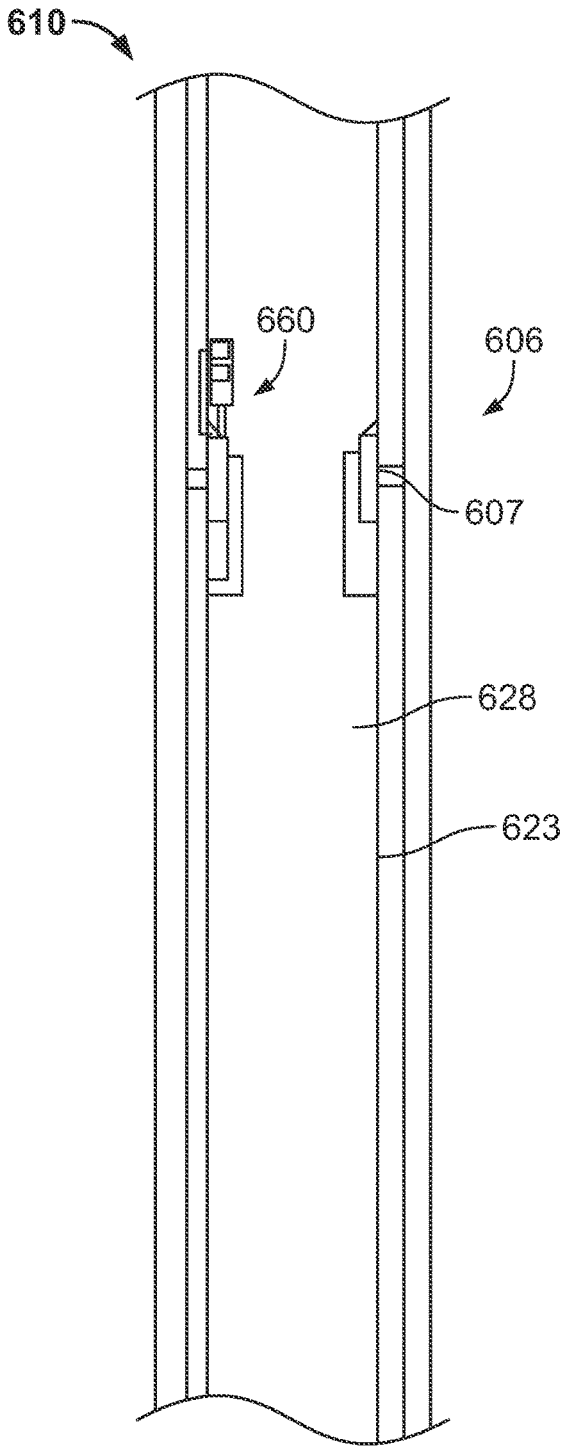
FIG. 6 is a front schematic view, cross-sectional, of a sub with a shifting sleeve.

FIG. 6 shows an implementation of a sleeve assembly 606 in a standalone sub 610. The standalone sub 610 includes a drive assembly 660 and a sleeve assembly 606 similar to the drive assembly 260 and sleeve assembly 206 shown in FIGS. 3-5. The sub 610 includes a tubular body 623 that defines a bore 628 that flows fluid 'F' received from the wellbore string. The sub 610 can be an integral component of a wellbore string such as a drill string. Once it is determined that an obstruction downhole of the sleeve assembly 606 is blocking a main fluid pathway, the sleeve assembly 606 can be activated similar to the process shown in FIGS. 3-5 to move the sleeve 607 of the sub 610.

Figure 7:
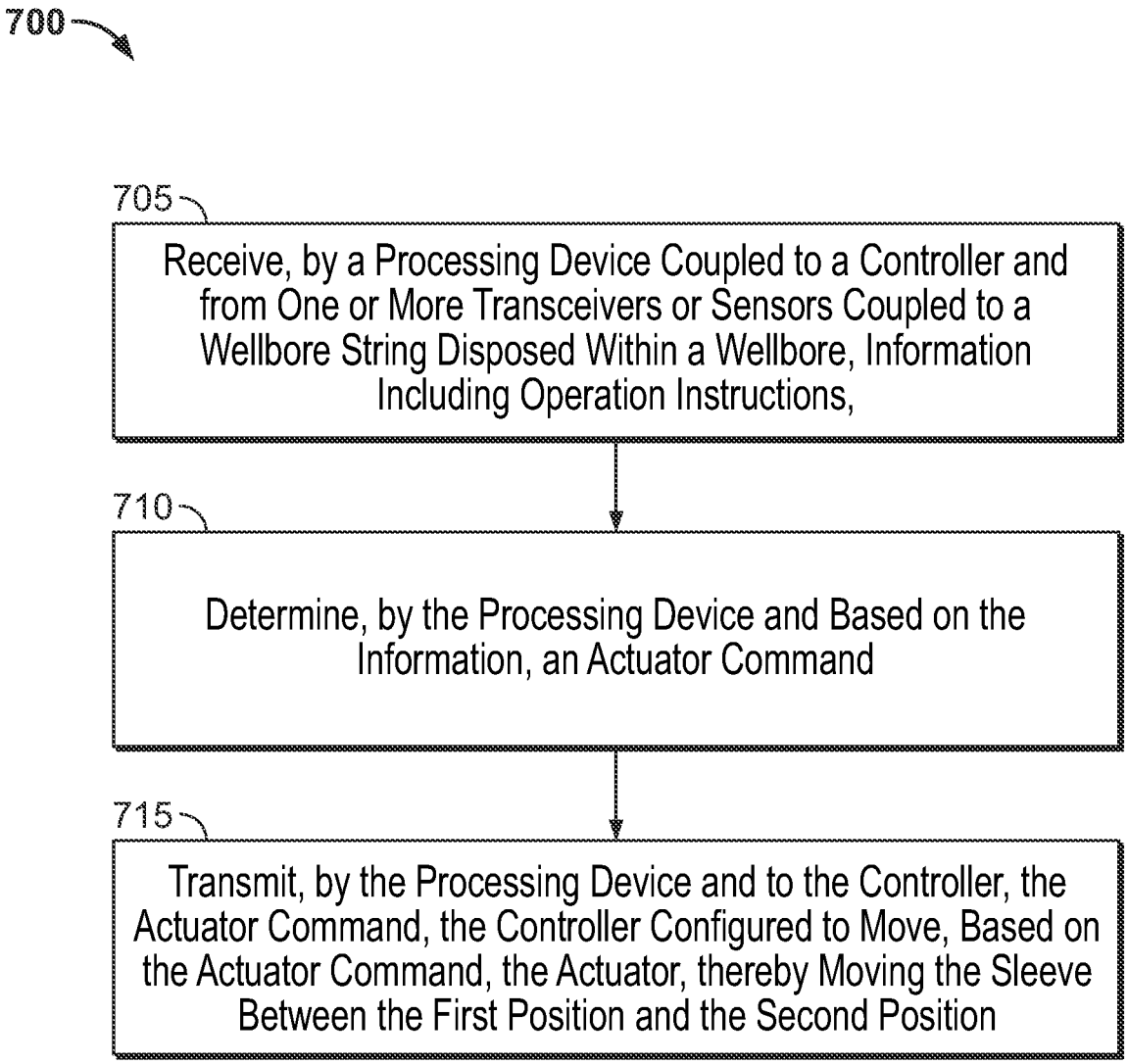
FIG. 7 is a flow chart of an example method of opening a fluid pathway in a float collar.

FIG. 7 shows a flow chart of an example method 700 of opening an alternate fluid pathway. The method includes receiving, by a processing device coupled to a controller and from one or more transceivers or sensors coupled to a wellbore string disposed within a wellbore, information including operation instructions. The controller is operationally coupled to an actuator configured to move a sleeve between a first position with a fluid port of the wellbore string exposed and a fluid pathway between a bore of the wellbore string and an annulus of the wellbore open, and a second position with the fluid port covered and the fluid pathway closed (705). The method also includes determining, by the processing device and based on the information, an actuator command (710). The method also includes transmitting, by the processing device and to the controller, the actuator command. The controller is configured to move, based on the actuator command, the actuator, thereby moving the sleeve between the first position and the second position (715).

Figure 8:
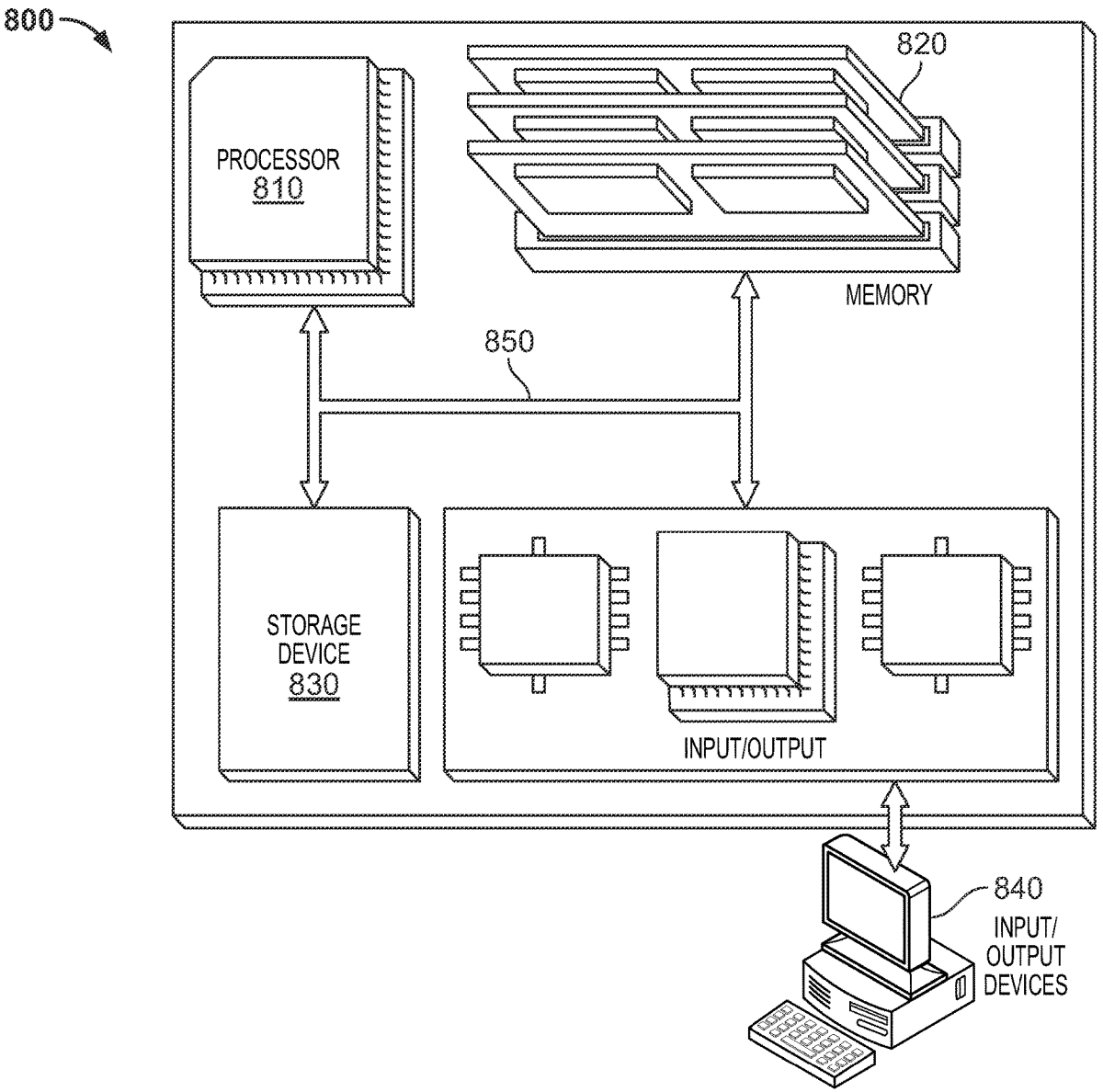
FIG. 8 is a schematic illustration of an example control system or controller according to implementations of the present disclosure.

FIG. 8 is a schematic illustration of an example control system or controller for a flow meter according to the present disclosure. For example, the controller 800 may include or be part of the controller 262 shown in FIG. 3 or may include or be part of the controller 262 and processor 261 shown in FIG. 3. The controller 800 is intended to include various forms of digital computers, such as printed circuit boards (PCB), processors, digital circuitry, or otherwise. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 800 includes a processor 810, a memory 820, a storage device 830, and an input/output device 840. Each of the components 810, 820, 830, and 840 are interconnected using a system bus 850. The processor 810 is capable of processing instructions for execution within the controller 800. The processor may be designed using any of a number of architectures. For example, the processor 810 may be a CISC (Complex Instruction Set Computers) processor, a RISC (Reduced Instruction Set Computer) processor, or a MISC (Minimal Instruction Set Computer) processor.

In one implementation, the processor 810 is a single-threaded processor. In another implementation, the processor 810 is a multi-threaded processor. The processor 810 is capable of processing instructions stored in the memory 820 or on the storage device 830 to display graphical information for a user interface on the input/output device 840.

The memory 820 stores information within the controller 800. In one implementation, the memory 820 is a computer-readable medium. In one implementation, the memory 820 is a volatile memory unit. In another implementation, the memory 820 is a non-volatile memory unit.

The storage device 830 is capable of providing mass storage for the controller 800. In one implementation, the storage device 830 is a computer-readable medium. In various different implementations, the storage device 830 may be a floppy disk device, a hard disk device, an optical disk device, or a tape device.

The input/output device 840 provides input/output operations for the controller 800. In one implementation, the input/output device 840 includes a keyboard and/or pointing device. In another implementation, the input/output device 840 includes a display unit for displaying graphical user interfaces.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A wellbore assembly comprising:

a wellbore string configured to be disposed within a wellbore; and a float collar coupled to a downhole end of the wellbore string, the float collar comprising, a housing coupled to the wellbore string and comprising a fluid outlet at a downhole end of the housing, the housing defining a fluid port extending through a wall of the housing, the housing comprising a bore configured to flow a fluid received from the wellbore string, a check valve disposed within the housing between the fluid port and the fluid outlet, the check valve configured to allow the fluid to flow in one direction along the bore of the float collar, a sleeve coupled to the wall of the housing uphole of the check valve, the sleeve configured to move, based on pressure changes of the fluid in the float collar, with respect to the wall of the housing thereby either exposing the fluid port and opening a fluid pathway from the bore to an annulus of the wellbore, or covering the fluid port and blocking the fluid pathway, a processor coupled to the float collar, a controller communicatively coupled to the processor, an actuator communicatively coupled to the controller and operationally coupled to the sleeve and configured to move the sleeve, and a transceiver or a sensor communicatively coupled to the processor, the transceiver or sensor configured to detect and transmit, to the processor, pressure information of the fluid, the processor configured to determine, based on the pressure information, an actuator command, the processor configured to transmit the actuator command to the controller and the controller is configured to activate, based on the actuator command, the actuator, moving the sleeve between the first position and the second position.

2. The wellbore assembly of claim 1, further comprising a biasing member coupled to the sleeve, the sleeve configured to move between a first position with the fluid port covered and a second position with the fluid port exposed, the biasing member configured to urge the sleeve from the second position to the first position with the fluid at a first pressure, and the sleeve configured to move from the first position to the second position under fluidic pressure of the fluid at a second pressure greater than the first pressure.

3. The wellbore assembly of claim 2, further comprising a push-push assembly coupled to the sleeve and configured to allow movement of the sleeve between the first position in which the sleeve is in a latched condition, and the second position in which the sleeve is in an unlatched condition, the sleeve configured to be moved by the biasing member or fluidic pressure in a direction parallel to the flow direction of the fluid, thereby alternately moving the sleeve into the first position and the second position as the sleeve is pushed by the biasing member or the fluidic pressure.

4. The wellbore assembly of claim 1, wherein the transceiver or sensor comprises a radio-frequency identification (RFID) device comprising a piezoelectric crystal configured to generate, under pressure changes of the fluid, electric signals including encoded information, the RFID device configured to transmit, to the processor, the encoded information and the processor configured to determine, based on the decoded information, an actuator command, the processor configured to transmit the actuator command to the controller and the controller is configured to activate, based on the actuator command, the actuator, moving the sleeve between the first position and the second position.

5. The wellbore assembly of claim 1, wherein the pressure information comprises instructions encoded in pressure pulses of the fluid, the pressure pulses sent through the wellbore string upon determining that a main fluid pathway of the wellbore string is clogged.

6. The wellbore assembly of claim 1, wherein the transceiver or sensor is configured to detect and transmit, to the processor, information from a triggering device flown in the fluid along the bore of the housing, the processor configured to determine, based on the information from the triggering device, second actuator command, the processor configured to transmit the second actuator command to the controller and the controller is configured to activate, based on the second actuator command, the actuator, moving the sleeve between a first position and a second position.

7. The wellbore assembly of claim 6, wherein the transceiver or sensor comprises a first RFID device and the triggering device comprises a second RFID device, one of the first and second RFID devices comprising a radio transmitter and the other of the first and second RFID devices comprising a radio receiver, the first RFID device configured to transmit, to the processor, encoded information received from the radio transmitter, the processor configured to decode the information and configured to determine, based on the decoded information, the second actuator command, the processor configured to transmit the second actuator command to the controller and the controller is configured to activate, based on the second actuator command, the actuator, moving the sleeve between the first position and the second position.

8. The wellbore assembly of claim 1, wherein the float collar is part of a completion string comprising a float shoe disposed downhole of the float collar, and a polished bore receptacle coupled to the float collar.

9. The wellbore assembly of claim 1, wherein the sleeve is disposed inside the housing, the sleeve comprising one or more sealing rings disposed between the sleeve and the wall of the housing to form a fluid seal between the bore and the annulus with the sleeve in the first position.

10. A wellbore assembly, comprising:

a wellbore string configured to be disposed within a wellbore, the wellbore string comprising a tubular body defining a bore configured to flow fluid from a surface of the wellbore to a downhole end of the wellbore, the wellbore string comprising a fluid outlet at the downhole end of the wellbore and comprising a fluid port extending through the tubular body and residing uphold of the fluid outlet;

a sleeve coupled to the tubular body uphole of the fluid outlet, the sleeve configured to move, based on pressure changes in the wellbore string, with respect to the tubular body, thereby either exposing the fluid port and opening a fluid pathway from the bore to an annulus of the wellbore, or covering the fluid port and blocking the fluid pathway;

a processor coupled to the tubular body, a controller communicatively coupled to the processor, an actuator communicatively coupled to the controller and operationally coupled to the sleeve and configured to move the sleeve, and a transceiver or a sensor communicatively coupled to the processor, the transceiver or sensor configured to detect and transmit, to the processor, pressure information of the fluid, the processor configured to determine, based on the pressure information, actuation information, the processor configured to transmit the actuation information to the controller and the controller is configured to activate, based on the actuation information, the actuator, moving the sleeve between the first position and the second position.

11. The wellbore assembly of claim 10, wherein the sleeve is disposed inside a sub comprising the fluid ports and coupled to the wellbore string, the sub comprising:

a tubular wall comprising the fluid port, and a spring coupled to the sleeve, the sleeve configured to move between a first position with the fluid port covered and a second position with the fluid port exposed, the spring configured to move the sleeve from the second position to the first position with the fluid at a first pressure, and the sleeve configured to move from the first position to the second position under fluidic pressure of the fluid at a second pressure greater than the first pressure.

12. The wellbore assembly of claim 11, further comprising a push-push assembly coupled to the sleeve and configured to allow movement of the sleeve between the first position in which the sleeve is in a latched condition, and the second position in which the sleeve is in an unlatched condition, the sleeve configured to me moved by the biasing member or fluidic pressure in a direction parallel to the flow direction of the fluid, thereby alternately moving the sleeve into the first position and the second position as the sleeve is pushed by the biasing member or the fluidic pressure.

13. A wellbore assembly, comprising:

a wellbore string configured to be disposed within a wellbore, the wellbore string comprising a tubular body defining a bore configured to flow fluid from a surface of the wellbore to a downhole end of the wellbore, the wellbore string comprising a fluid outlet at the downhole end of the wellbore and comprising a fluid port extending through the tubular body and residing uphold of the fluid outlet;

a sleeve coupled to the tubular body uphole of the fluid outlet, the sleeve configured to move, based on pressure changes in the wellbore string, with respect to the tubular body, thereby either exposing the fluid port and opening a fluid pathway from the bore to an annulus of the wellbore, or covering the fluid port and blocking the fluid pathway, a processor coupled to the tubular body, a controller communicatively coupled to the processor, an actuator communicatively coupled to the controller and operationally coupled to the sleeve and configured to move the sleeve, and a transceiver or a sensor communicatively coupled to the processor, the transceiver or sensor configured to detect and transmit, to the processor, information from a triggering device flown in the fluid along wellbore string, the processor configured to determine, based on the pressure information, actuation information, the processor configured to transmit the actuation information to the controller and the controller is configured to activate, based on the actuation information, the actuator, moving the sleeve between the first position and the second position.

14. A method comprising:

receiving, by a processing device coupled to a controller and from one or more transceivers or sensors coupled to a wellbore string disposed within a wellbore, information including operation instructions, the controller operationally coupled to an actuator configured to move a sleeve between a first position with a fluid port of the wellbore string exposed and a fluid pathway between a bore of the wellbore string and an annulus of the wellbore open, and a second position with the fluid port covered and the fluid pathway closed;

determining, by the processing device and based on the information, an actuator command; and transmitting, by the processing device and to the controller, the actuator command, the controller configured to move, based on the actuator command, the actuator, thereby moving the sleeve between the first position and the second position;

wherein the one or more transceivers or sensors comprises an RFID device and the information comprises encoded information transmitted via pressure pulses, the RFID device configured to transmit the encoded information to the processor and the processor configured to decode the encoded information.

15. The method of claim 14, wherein the actuator command comprises one of 1) instructions to extend the actuator thereby exposing the fluid port or 2) instructions to retract the actuator thereby covering the fluid port.

16. The method of claim 15, wherein the actuator command comprises instructions to extend the actuator upon determining that a main fluid outlet of the wellbore string is blocked.

17. The method of claim 14, wherein the RFID device comprises a first RFID device and the information comprises encoded information transmitted via electromagnetic waves from a second RFID device flown with the fluid along the wellbore string, the first RFID device configured to transmit the encoded information to the processor and the processor configured to decode the encoded information.

* * * * *